US007621423B2

(12) United States Patent
Winckels

(10) Patent No.: US 7,621,423 B2
(45) Date of Patent: Nov. 24, 2009

(54) DEFORMABLE CONTAINER

(75) Inventor: Mathilde Winckels, Clichy (FR)

(73) Assignee: L'Oreal, Paris (FR)

( * ) Notice: Subject to any disclaimer, the term of this patent is extended or adjusted under 35 U.S.C. 154(b) by 1341 days.

(21) Appl. No.: 10/373,016

(22) Filed: Feb. 26, 2003

(65) Prior Publication Data

US 2003/0183639 A1 Oct. 2, 2003

(30) Foreign Application Priority Data

Feb. 26, 2002 (FR) ..... 02 02424

(51) Int. Cl.
*B65D 1/42* (2006.01)

(52) U.S. Cl. ..... 220/654

(58) Field of Classification Search ..... 220/654, 220/653, 651, 9.1; 206/581, 823
See application file for complete search history.

(56) References Cited

U.S. PATENT DOCUMENTS

| | | | | |
|---|---|---|---|---|
| 553,765 | A * | 1/1896 | Ruppolt | 239/327 |
| 2,517,757 | A * | 8/1950 | Adlerstein | 312/3 |
| 2,591,296 | A * | 4/1952 | Rogers | 222/211 |
| 2,785,725 | A * | 3/1957 | Gold | 220/9.1 |
| 3,067,810 | A * | 12/1962 | Mozic | 222/95 |
| 3,162,885 | A | 12/1964 | Tanner | |
| 3,341,083 | A * | 9/1967 | Stewart | 222/209 |
| 4,013,195 | A * | 3/1977 | Ferris | 222/95 |
| 4,093,009 | A * | 6/1978 | Iavarone et al. | 206/524.8 |
| 4,098,434 | A | 7/1978 | Uhlig | |
| 4,456,134 | A | 6/1984 | Cooper | |
| 4,600,130 | A * | 7/1986 | Libit | 222/209 |
| 5,348,194 | A * | 9/1994 | Mascitelli et al. | 222/209 |
| 5,356,024 | A * | 10/1994 | Ho et al. | 220/9.2 |
| 5,439,146 | A * | 8/1995 | Niss | 222/207 |
| 5,445,288 | A * | 8/1995 | Banks | 222/95 |
| 6,536,635 | B1 * | 3/2003 | Garcia et al. | 222/633 |
| 6,769,579 | B2 * | 8/2004 | Milian | 222/632 |
| 2004/0144811 | A1 * | 7/2004 | Pennaneac'H | 222/633 |

FOREIGN PATENT DOCUMENTS

| | | |
|---|---|---|
| EP | 0 661 012 | 7/1995 |
| EP | 1 136 387 | 9/2001 |
| FR | 1 570 600 | 6/1969 |

OTHER PUBLICATIONS

U.S. Appl. No. 10/388,523, filed Mar. 17, 2003, Winckels.
Patent Abstracts of Japan, JP 09 226785 A (Sep. 02, 1997) Yoshino Kogyosho Co. Ltd., "Liquid Discharging Container," Inventor: Yamanaka Nobuo.

* cited by examiner

*Primary Examiner*—Stephen Castellano
(74) *Attorney, Agent, or Firm*—Oblon, Spivak, McClelland, Maier & Neustadt, L.L.P.

(57) ABSTRACT

A container for packaging a product includes a casing made of a first material, and at least one deform able part in contact with the product and made of a second material with a lesser rigidity than the first material. The container is configured so that a pressure exerted on the deformable part causes a deformation of the latter and a displacement of the product towards the opening of the container. The deformable part can return to its undeformed shape when the pressure is released.

70 Claims, 3 Drawing Sheets

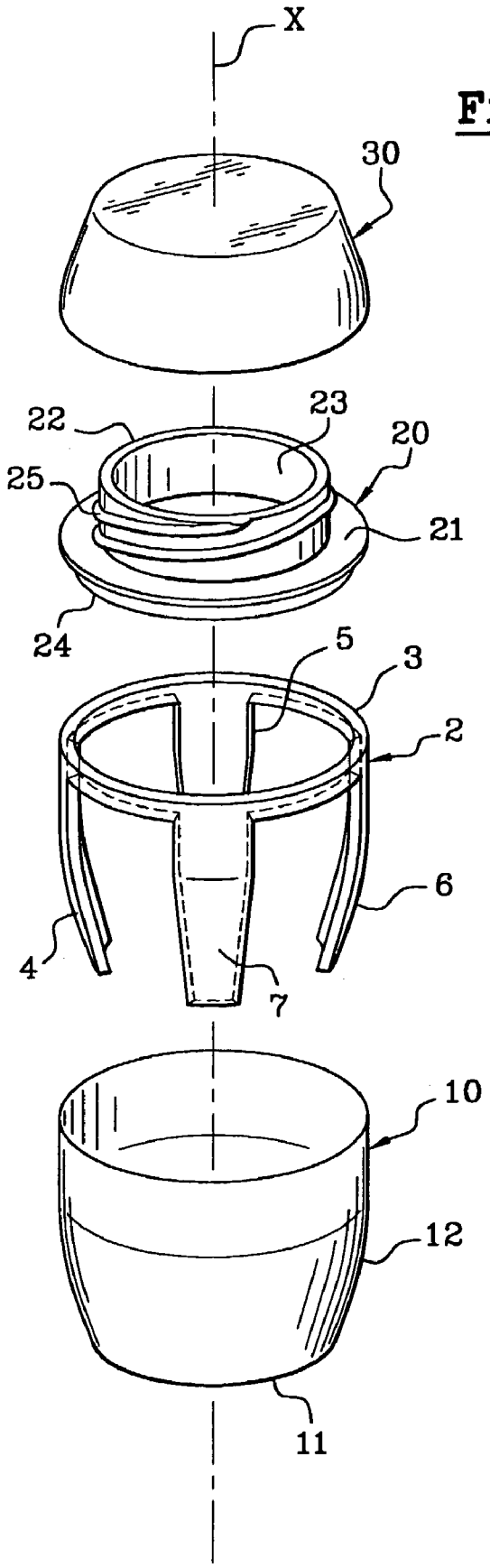
Fig. 1
Fig. 2
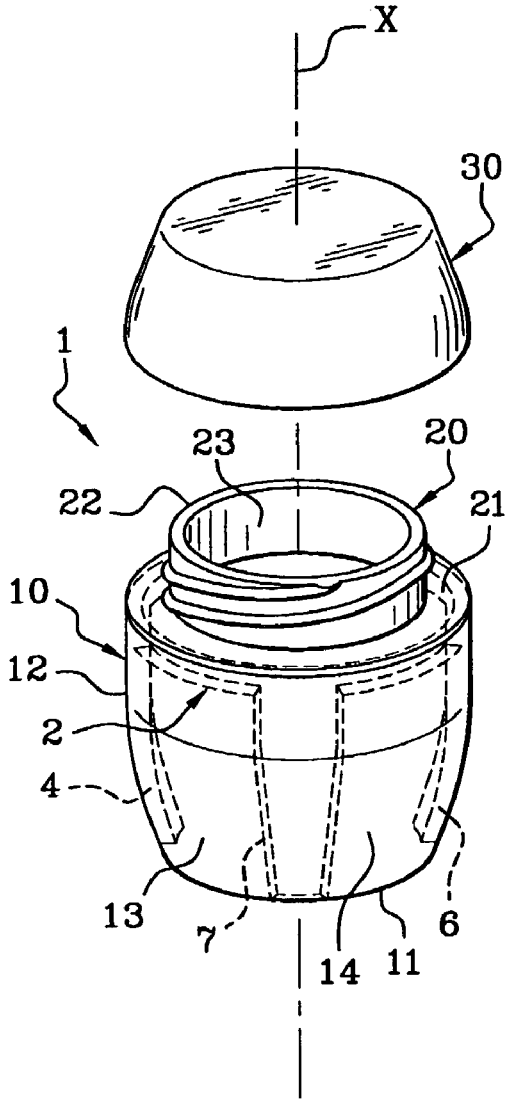

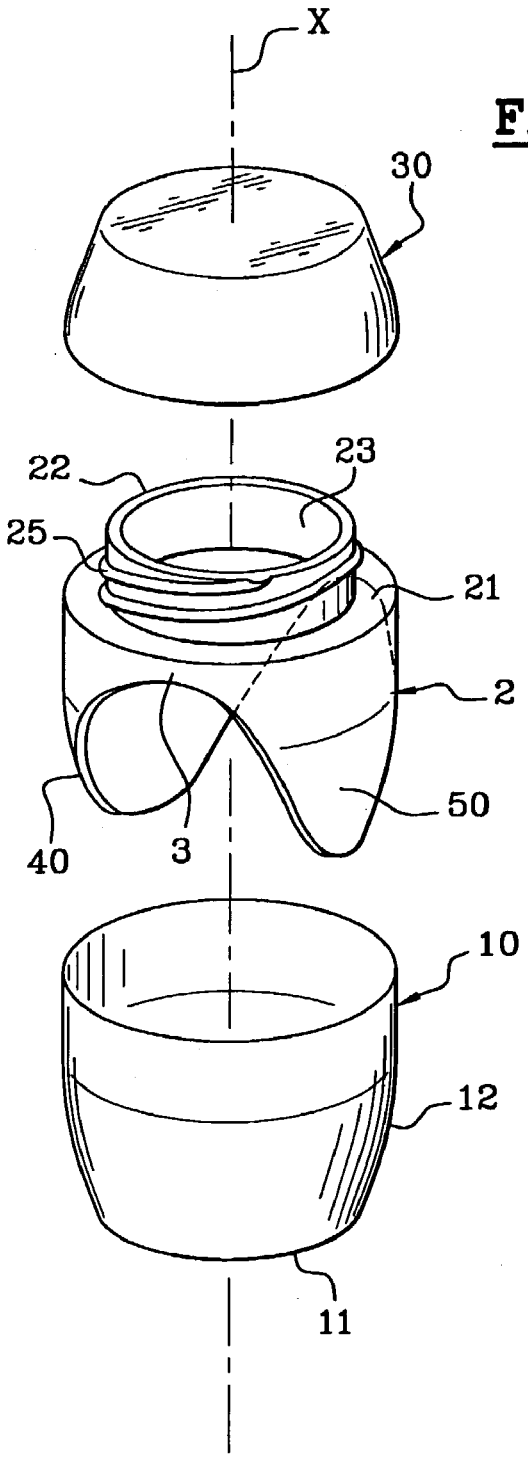
Fig. 4
Fig. 5
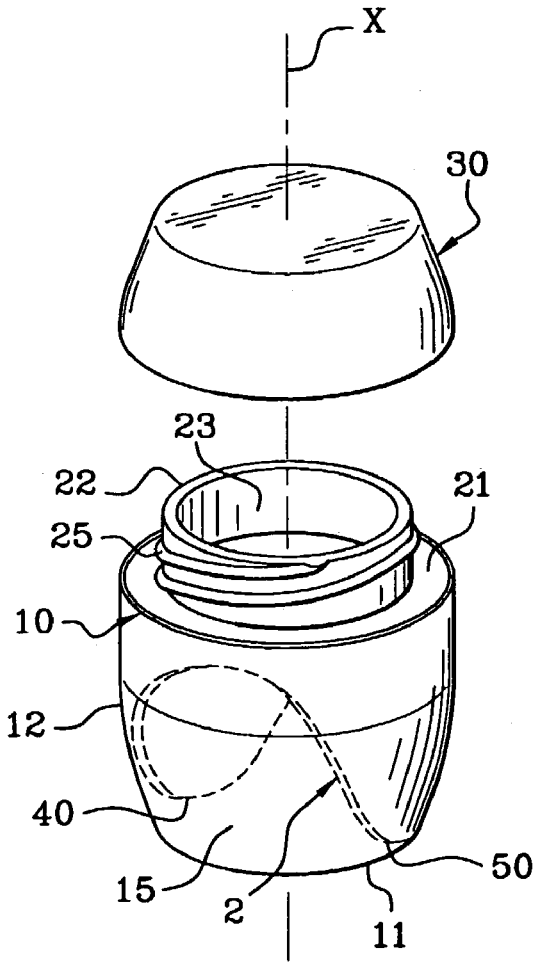

DEFORMABLE CONTAINER

CROSS REFERENCE TO RELATED APPLICATIONS:

This document claims priority to French application number 0202424 filed Feb. 26, 2002, the entire content of which is hereby incorporated by reference.

FIELD OF THE INVENTION

The present invention relates to containers, for example, used for packaging cosmetic products, such as a gel or a cream.

BACKGROUND OF THE INVENTION

Discussion Of Background

In the field of cosmetics, a user often extracts an amount of a cosmetic product from a container using one or more fingers introduced into the container. Naturally, the operation can become increasingly difficult as the fingers reach for the product located near the bottom of the container, in particular for containers with a small cross section relative to their height.

Containers equipped with plunger or bellows systems are known. These containers can be configured so as to cause dosed delivery of a product stored inside the container in response to a pressure exerted on the bottom of the container, or in response to a rotation of an operating component.

For example, French Patent No. 1 570 600 describes a device having an outer packaging and an inner packaging, in the form of bellows, fitted on a plunger. The plunger is displaced upwards, so as to compress the bellows as the number of uses increases and to cause delivery of the product, either by manually pressing directly on the bottom or by rotating the outer packaging with respect to a dispensing device secured to the inner packaging. The mechanism is relatively complex. The price of the container is, therefore, relatively high and incompatible with the economic requirements dictated by large retail networks.

U.S. Pat. No. 4,456,134 describes another packaging system, in which the volume of a container is adjusted by reducing the height of a flexible part, for example, of the bellows type, by screwing two cylindrical parts onto one another to form an outer packaging. The visible height of the container is commensurately reduced. As for the previously discussed device, this system is relatively complex and expensive.

SUMMARY OF THE INVENTION

An object of the present invention is to provide a container that facilitates the dispensing of its contents and that alleviates all or some of the problems discussed above with reference to the conventional devices. In particular, an object of the present invention is to provide a container that is relatively economical to manufacture and simple to use.

Another object of the present invention is to provide a container for which a similar hand movement can be used repeatedly for removing some of the product with a finger, and for which the ease of removing does not substantially deteriorate as the number of removing operations increases.

Other objects will also become apparent from the following detailed description.

According to the present invention, all or some of these objects can be achieved by a container including an openworked casing formed by at least one extension member extending over a substantial portion of the height of the container. The container also includes a deformable part, which can be in contact with the product inside the container. The deformable part can be made of a material with a lesser rigidity than the material used for the casing. The container can be configured so that a pressure exerted on the deformable part causes a deformation of the latter and a displacement of the product towards an opening of the container, the deformable part returning to its undeformed shape when the pressure is released.

The presence of one or more deformable parts enables a user, as the level of the product decreases inside the container, to bring the product near the opening of the container so that the product can be removed easily with the finger.

The presence of the casing can give the container a consistency and a rigidity which are sufficient for the casing to be stackable, for example, during its transport or storage. Preferably, the casing is rigid (i.e., it is formed of a material having a greater rigidity than the container shell). The presence of the rigid casing can also help return the container to its undeformed shape, which can be maintained throughout the life of the product.

Preferably, the container has at least one deformable portion so that the container can be deformed in response to a pressure exerted transversely to a longitudinal axis of the container. The hand movements for using the container can thus be facilitated.

In a preferred embodiment, the extension members forming the openworked casing are secured to one another via their ends positioned near of the neck of the container. The ends positioned near the bottom of the container can be free. According to this preferred embodiment, the bottom can also form a deformable region.

In another preferred embodiment, the angular width of these extension members increases towards the neck of the container. In contrast, the deformable regions lying between the members forming the openwork casing have an area which increases progressively towards the bottom. Such a configuration gives the container a greater deformability in the vicinity of the bottom, hence making it easier to empty the container.

In one embodiment, the neck can be obtained by molding the casing. According to another embodiment, the neck is formed by a separate piece which is fitted on the casing, for example, by adhesive bonding, welding, such as ultrasonic welding, or snap-fastening.

At the opposite end from the neck, the container can have a bottom, which, preferably and as indicated above, forms a deformable part. The pressure exerted on the container via the deformable part or parts can hence be exerted laterally and also axially. To that end, and preferably, the extension members of the casing can terminate in the vicinity of the bottom in a free end.

Advantageously, the deformable part or parts can be molded over the casing. In this embodiment, the materials for the casing and the deformable parts can be chosen so as to be mutually compatible physico-chemically (i.e., so that they can be welded to one another relatively easily). For example, the casing can be made of polypropylene or polyethylene. The deformable part(s) can be made of an elastomeric material or a polyolefin obtained by metallocene catalysis. More specific examples include material (metallocene polyethylene) marketed under the brand name Exact™ by the company DSM, or alternatively a material (metallocene polypropylene) marketed under the brand name Metocene™ by the company TARGOR.

In a preferred embodiment, the rigid casing can be arranged inside the deformable part, and can also be in contact with the product. The rigid casing then improves the elastic return forces of the deformable part after the pressure exerted on it has been released. In a preferred embodiment, an outer surface of the neck can have a screw thread, which can interact with a corresponding screw thread of a lid.

Preferably, the container has an alternating sequence of at least two rigid extension members forming the casing, and of at least two deformable parts. The deformable parts can extend over a substantial portion of the height of the container. The container can have a circular cross section, in which case the casing can be formed of two diametrically opposite extension members, or any other number, greater than two, of rigid members which are regularly spaced.

The extension members can extend towards the bottom of the container along a direction generally parallel to the longitudinal axis of the container. The extension members can thus have an axis which is generally parallel to the longitudinal axis of the container. The extension members can also extend towards the bottom of the container along a direction which is oblique with respect to the longitudinal axis of the container. The extension members can thus have an axis which is generally oblique with respect to the longitudinal axis of the container. In this context, "oblique" includes not only directions towards or away from the longitudinal axis so that the axes of the extension members can intersect the longitudinal axis of the container, but also includes directions, which are not parallel to, and which do not intersect, the longitudinal axis. Alternatively, each extension member can have a portion that extends towards the bottom of the container along a direction generally parallel to the longitudinal axis of the container, and another portion that extends towards the bottom of the container along a direction oblique with respect to the longitudinal axis of the container. Alternatively, the extension members can extend towards the bottom of the container along a curve-linear direction.

Advantageously, the material for the deformable parts can be transparent or translucent. In addition to seeing the level of product remaining in the container, this feature enables the user to know the positions where the pressure should be applied so as to deform the container. The container according to the invention can advantageously be used for packaging a cosmetic product, for example, a product for hairdressing, for skincare or for scalp treatment.

BRIEF DESCRIPTION OF THE DRAWINGS

A better appreciation of the invention and many of the attendant advantages thereof will become further apparent from the following detailed description, particularly when read in conjunction with the accompanying drawings of which:

FIGS. 1 and 2 are views relating to a first embodiment of the invention;

FIGS. 4 and 5 relate to a second embodiment.

DETAILED DESCRIPTION OF THE PREFERRED EMBODIMENTS

Figure 3:
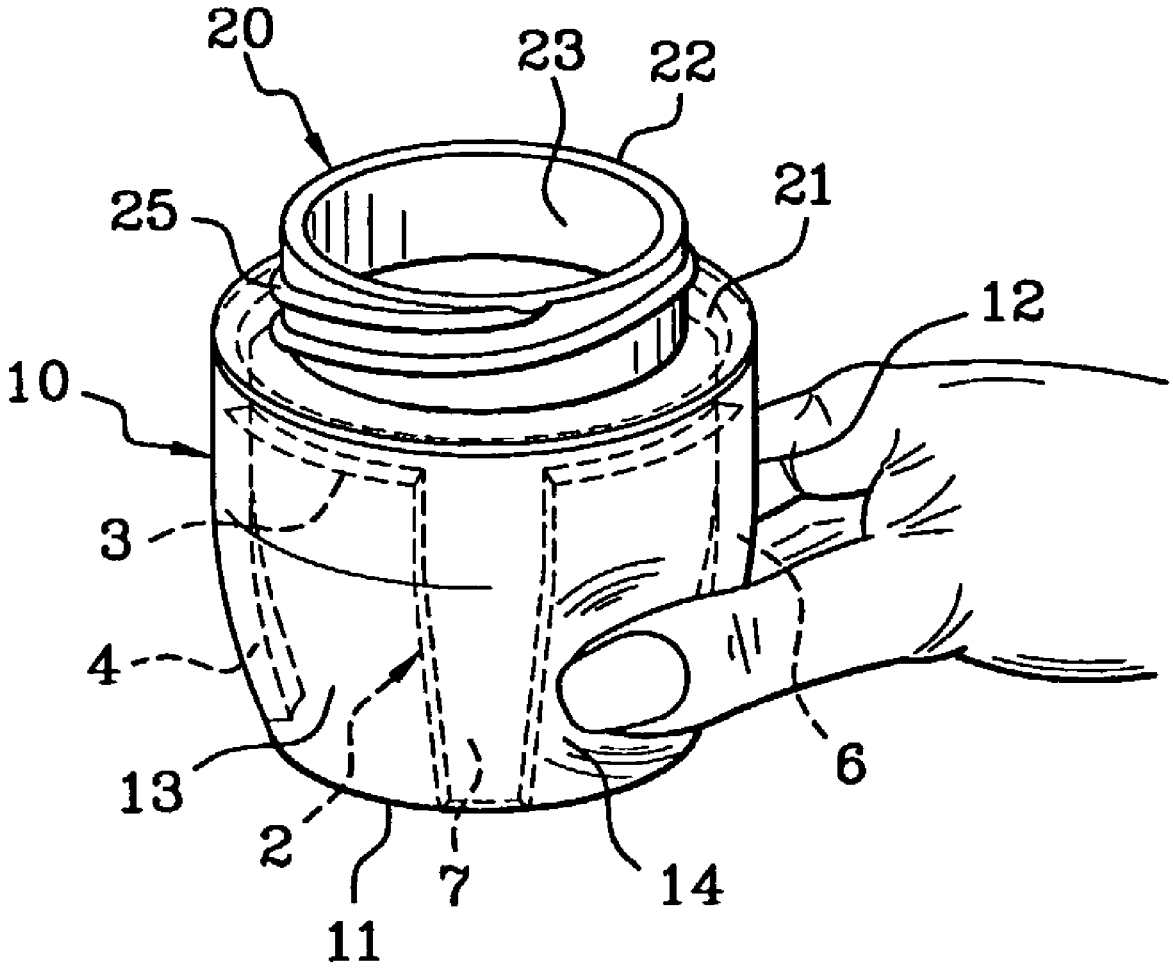
FIG. 3 illustrates the use of the container represented in FIGS. 1 and 2.

The container 1 represented in FIGS. 1 and 2 includes an openworked casing or frame 2, of axis X, obtained, for example, by molding a rigid material, such as a polypropylene. The casing 2 forms a ring 3, from one edge of which four regularly spaced members 4-7 extend. The height of these extension members corresponds substantially to the height of the container. Over a part of their height adjacent to the ring 3, the members 4-7 are substantially parallel to the axis X. The members converge slightly towards the longitudinal axis X over the rest of their height, so as to provide a profile corresponding to the container. In this example, the ends of members 4-7, opposite to the ring 3, are free. Over their portions which converge towards the longitudinal axis X, the members 4-7 have an angular width which decreases slightly towards their free ends.

The present invention is not limited to these configurations. For example, the members 4-7 can extend along other directions, for example, away from the longitudinal axis, or at an angle so that the axes of the extension members never intersect the longitudinal axis X. Furthermore, the width of the extension members can have other width profiles. For example, they can have a width that stays constant over their length, decreases over their entire length, increases towards their free ends, or alternately increases and decreases. In addition, different extension members of a same casing can have different width profiles.

An outer shell 10 made of flexible material is molded over the rigid casing 2. The outer shell 10 has a bottom 11 adjacent to the free ends of the members 4-7, and a circumferential side wall 12, which can be matched to the profile of the members 4-7 and extends substantially as far as the upper edge of the ring 3 of the casing 2. The members 4-7 hence extend inside the shell 10, the shell 10 being intended and configured to contain the product. The side wall 12 and the bottom 11 can be formed of a same material, or of different materials.

Each member 4-7 extends from the ring 3 toward the bottom 11 along a portion of the side wall 12. The bottom 11 is connected to the side wall 12 at a bottom-end of side wall 12. The top-end of the side wall 12 defines a shell opening, which is co-axial with the ring 3. As illustrated in FIG. 2, the ring 3 is coupled to the top-end of the side wall 12. The side wall 12 has a profile such that the opening defined by the side wall 12 has a diameter greater than a diameter of the bottom 11. The casing 2 has a profile that matches the profile of the side wall 12. In particular, the members 4-7 converge toward the longitudinal axis X of the shell 10 as the members 4-7 extend toward the bottom 11.

The shell 10 defines four deformable portions (two of which are shown in FIG. 2 as portions 13-14). Each of these deformable portions are positioned between the portions of the side wall along which the members 4-7 extend. In other words, the members 4-7 are positioned against a first plurality of portions of an inside surface of the side wall 12. The inside surface of the side wall 12 includes a second plurality of portions 13-14, which are deformable and in contact with the product. The portions from these first and second pluralities alternate.

The material used to produce the flexible shell 10 can be a soft material, which can be physico-chemically compatible with the material forming the casing 2, so that they can be welded together intimately at the positions where the two materials overlap, in particular, over the entire surface of the ring 3. For example, Exact™ or Metocene™ can be used. The material forming the flexible shell 10 is preferably transparent. By way of example, the color of the material forming the casing 2 can be such that the casing 2 can be seen through the deformable shell 10.

The arrangement of the openworked casing 2 and of the flexible shell 10 hence provides a structure which has deformable regions, such as portions 13-14, between the members 4-7 of the casing. The bottom 11 likewise forms a deformable portion, on which it is possible to exert an axial pressure in order to help raise the product towards the opening.

After the rigid casing 2 (i.e., with the casing more rigid than the shell 10) lined with the flexible shell 10 has been formed, a piece 20 can be ultrasonically welded to the upper part of the casing 2. The piece 20 has a shoulder 21 and a neck 22, which delimits an opening 23 of the container 1. The piece 20 has a short peripheral skirt 24 with an outer diameter slightly smaller than the inner diameter of the ring 3 of the casing 2. The welding can be carried out level with the skirt 24.

On its outer surface, the neck 22 has a screw thread 25 which can interact with a complementary screw thread provided on an inner surface of a lid or stopper 30. The piece 20 is made of a rigid material which can be identical to or different from the material forming the casing 2.

The container 1 is represented in its working configuration in FIG. 3. As can be seen from this figure, after having taken the stopper 30 off, the user presses the container between her thumb and index finger at the positions 13-14 of the flexible shell 10 which lie between two members 4-7 forming the casing 2. In other words, the deformable portions 13-14 move through openings, defined in the casing 2 between the members 4-7, when the deformable portions 13-14 move from an undeformed position to a deformed position as a result of the user applying pressure on the deformable portions 13-14. In this way, the cross section of the container is reduced (i.e., the interior volume of the shell 10 decreases), and the product is forced towards the opening 23 of the container 1. At that point, the user can relatively easily remove some of the product using a finger.

When the user releases the pressure being exerted on the container 1, the deformable parts 13-14 of the container 1 return to their original shape by elastic return forces, hence moving the product stored in the container away from the opening 23. Some of the pressure exerted on the shell 10 can also be transmitted to the members 4-7, the returning force of which can thus accentuate the elastic return of the deformable parts 13-14.

The embodiment shown in FIGS. 4 and 5 differs from the previous embodiment principally as follows. First, instead of the four members 4-7 arranged at 90°, the casing 2 includes two diametrically opposite members 40, 50, having a height substantially equal to the height of the container and having a width which increases progressively towards an annular upper part 3. Furthermore, the shoulder 21 and the neck 22 form an integral part of the casing 2, and they are obtained by molding with the latter. Otherwise, the container according to this embodiment is similar to the previous embodiment and operates in the similar manner.

This embodiment is particularly advantageous because it includes deformable regions 15 which, although there are fewer of them, have a larger area compared to the embodiment shown in FIGS. 1 and 2. This feature improves the deformability of the container, and facilitates the removal of the product. Likewise, although there are fewer members 40, 50 form the casing 2, they have a larger area. This feature leads to increased rigidity compared with the previous embodiment.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A container for packaging a product, comprising:

a rigid casing formed by at least one member extending over a substantial portion of a height of the container, and terminating in a neck having a free edge that delimits an opening for the container, said casing being made of a first material; and at least one deformable part in contact with the product inside the container and made of a second material with a lesser rigidity than the first material, wherein a pressure exerted on said at least one deformable part causes a deformation of said at least one deformable part and a displacement of the product towards the opening, said at least one deformable part returning to an undeformed shape by elastic return forces when said pressure is released, wherein said casing is arranged inside said at least one deformable part in contact with the product.

2. A container according to claim 1, wherein said at least one deformable part deforms in response to pressure exerted on said at least one deformable part in a direction transverse to a longitudinal axis of the container.

3. A container according to claim 1, wherein the neck is molded out of said casing.

4. A container according to claim 1, wherein the neck is a separate piece fitted on the casing.

5. A container according to claim 1, further comprising a deformable bottom opposite from the neck.

6. A container according to claim 1, wherein said at least one deformable part is molded over the casing.

7. A container according to claim 1, wherein the casing is made of polypropylene or polyethylene.

8. A container according to claim 1, wherein said at least one deformable part is made of an elastomeric material or a polyolefin obtained by metallocene catalysis.

9. A container according to claim 1, further comprising a lid, and wherein an outer surface of said neck has a screw thread which interacts with a corresponding screw thread of said lid.

10. A container according to claim 1, wherein the second material is transparent or translucent.

11. A container according to claim 1, wherein said product is a cream.

12. A container according to claim 1, wherein said product is a gel.

13. A container according to claim 1, wherein said product is a hairdressing product.

14. A container according to claim 1, wherein said product is a skincare product.

15. A container according to claim 1, wherein said product is a scalp treatment product.

16. A container according to claim 1, wherein said opening and an upper portion of said casing are circular and a diameter of said opening is smaller than a diameter of said upper portion.

17. A container according to claim 1, wherein said deformable part and said casing are configured to fit between a thumb and an index finger of a user's hand.

18. A container according to claim 1, wherein said displacement of the product enables a user to remove said product out from said container with a finger through said opening.

19. A container according to claim 1, wherein a diameter of said neck is larger than a diameter of a bottom of the container.

20. A container according to claim 1, wherein said neck is configured so that a user can insert a finger through said neck and remove some product from said container.

21. A container for packaging a product, comprising:

a rigid casing formed by at least one member extending over a substantial portion of a height of the container, and terminating in a neck having a free edge that delimits an opening for the container, said casing being made of a first material; and at least one deformable part in contact with the product inside the container and made of a second material with a lesser rigidity than the first material, wherein a pressure exerted on said at least one deformable part causes a deformation of said at least one deformable part and a displacement of the product towards the opening, said at least one deformable part returning to an undeformed shape by elastic return forces when said pressure is released, wherein said casing is formed of at least two members extending over said substantial portion of said height of said container, said at least two members being secured to each other via ends positioned near said neck, said at least two members having free ends positioned near a bottom of said container.

22. A container according to claim 21, wherein said at least two members have an angular width which increases towards the neck.

23. A container according to claim 21, wherein said casing is arranged inside said at least one deformable part in contact with the product.

24. A container for packaging a product, comprising:

a rigid casing formed by at least one member extending over a substantial portion of a height of the container, and terminating in a neck having a free edge that delimits an opening for the container, said casing being made of a first material; and at least one deformable part in contact with the product inside the container and made of a second material with a lesser rigidity than the first material, wherein a pressure exerted on said at least one deformable part causes a deformation of said at least one deformable part and a displacement of the product towards the opening, said at least one deformable part returning to an undeformed shape by elastic return forces when said pressure is released, wherein said casing is formed by an alternating sequence of at least two rigid members, and comprising at least two deformable parts extending over substantially said height of the container.

25. A container for a product, comprising:

a shell having a side wall and a bottom;

an openworked casing inside said shell, said casing comprising a ring and at least two members, each member extending from said ring toward said bottom along a portion of said side wall, and a neck coupled to said openworked casing; and a lid configured to close said opening;

wherein said shell defines at least two deformable portions, each of said at least two deformable portions being positioned between two of said portions of said side wall along which said members extend, wherein said neck delimits an opening of said container through which said product is dispensed when pressure is applied to said at least two deformable portions, wherein a pressure exerted on said shell causes a deformation of said shell, said shell returning to an undeformed shape by elastic return forces when said pressure is released.

26. A container according to claim 25, wherein said at least two members of said openworked casing define two openings in said casing, and each of said at least two deformable portions moves through one of said openings when said at least two deformable portions move from an undeformed position to a deformed position.

27. A container according to claim 26, wherein an interior volume of said shell decreases when said at least two deformable portions move from said undeformed position to said deformed position.

28. A container according to claim 25, wherein said openworked casing comprises four of said members and said shell comprises four of said deformable portions.

29. A container according to claim 25, wherein said members reach said bottom of said shell.

30. A container according to claim 25, wherein said bottom is connected to said side wall at a first end of said side wall and a second end of said side wall defines an opening for said shell, and wherein said ring is co-axial with said opening and coupled to said second end of said side wall.

31. A container according to claim 25, wherein said lid is configured to interact with said neck.

32. A container according to claim 31, wherein an outer surface of said neck has a screw thread which interacts with a corresponding screw thread of said lid.

33. A container according to claim 25, wherein said neck is welded to said ring of said openwork casing.

34. A container according to claim 25, wherein said opening and said ring of said openwork casing are circular and a diameter of said opening is smaller than a diameter of said ring.

35. A container according to claim 25, wherein said shell and said openworked casing are configured to fit between a thumb and an index finger of a user's hand.

36. A container for a product, comprising:

a shell including a circumferential side wall coupled to a bottom so as to receive said product, said side wall being formed of a first material; and a frame positioned inside said shell and against a first plurality of portions of an inside surface of said side wall, said frame being formed of a second material having a rigidity greater than said first material, wherein said frame comprises members having free ends positioned near a bottom of said container, wherein said inside surface of said side wall includes a second plurality of portions in contact with said product, and wherein said shell and said frame are configured to fit between a thumb and an index finger of a user's hand.

37. A container according to claim 36, wherein each of said portions from said second plurality is positioned between two of said portions from said first plurality.

38. A container according to claim 36, wherein said bottom is formed of said first material.

39. A container according to claim 36, wherein said side wall defines an opening for dispensing said product.

40. A container according to claim 39, wherein said shell has a longitudinal axis and said opening is co-axial with said longitudinal axis.

41. A container according to claim 40, wherein said second plurality of portions deform more under a pressure applied transversely with respect to said longitudinal axis than said first plurality of portions.

42. A container according to claim 39, wherein said shell has a longitudinal axis, said opening is co-axial with said longitudinal axis, and said frame defines a ring co-axial with said longitudinal axis.

43. A container according to claim 42, wherein said frame comprises a plurality of members extending from said ring toward said bottom along said first plurality of portions of said inside surface of said side wall.

44. A container according to claim 36, wherein said frame defines a ring, and said frame comprises a plurality of members extending from said ring toward said bottom along said first plurality of portions of said inside surface of said side wall.

45. A container according to claim 44, wherein said ring is welded to said side wall.

46. A container according to claim 45, wherein said casing comprises a ring and said members extending from said ring toward said bottom.

47. A container according to claim 46, wherein said members converge toward a longitudinal axis of said shell as said members extend toward said bottom.

48. A container according to claim 47, wherein said members are two diametrically opposed members.

49. A container according to claim 48, wherein said members have a width which decreases as said members extend toward said bottom.

50. A container according to claim 46, wherein said casing further comprises a neck integral with said ring.

51. A container according to claim 50, further comprising a lid which interacts with said neck.

52. A container according to claim 51, wherein said neck has an outer surface with a screw thread which interacts with a corresponding screw thread of said lid.

53. A container according to claim 36, further comprising:

a neck that delimits an opening of said container; and a lid configured to close said opening and configured to interact with said neck.

54. A container according to claim 53, wherein an outer surface of said neck has a screw thread which interacts with a corresponding screw thread of said lid.

55. A container according to claim 53, wherein said neck is welded to said frame.

56. A container according to claim 53, wherein said opening and an upper portion of said frame are circular and a diameter of said opening is smaller than a diameter of said upper portion.

57. A container according to claim 36, wherein said frame is formed of at least two members extending over a substantial portion of a height of said container, said at least two members being secured to each other via ends positioned near said neck.

58. A container according to claim 36, wherein said frame is formed by an alternating sequence of at least two rigid members, and comprising at least two deformable parts extending over substantially a height of the container.

59. A container according to claim 36, further comprising a neck coupled to said frame, said neck delimiting an opening of said container through which said product is dispensed when pressure is applied to said shell and the shell is deformed by said pressure.

60. A container for a product, comprising:

a flexible shell including a circumferential side wall coupled to a bottom so as to receive said product; and a rigid openworked casing positioned inside said flexible shell, wherein said side wall defines an opening for dispensing said product, said side wall having a profile such that said opening has a diameter greater than a diameter of said bottom, wherein said casing has a profile which matches said profile of said side wall, and wherein said flexible shell and said rigid openworked casing are configured to fit between a thumb and an index finger of a user's hand, wherein a pressure exerted on said shell causes a deformation of said shell, said shell returning to an undeformed shape by elastic return forces when said pressure is released.

61. A container according to claim 60, further comprising a lid configured to close said opening.

62. A container according to claim 60, wherein said product is dispensed through said opening when pressure is applied to said flexible shell by said user's hand and the flexible shell is deformed by said pressure.

63. A container according to claim 60, further comprising a neck coupled to said casing, said neck delimiting an opening of said container through which said product is dispensed when pressure is applied to said shell and the shell is deformed by said pressure.

64. A container for a product comprising:

a shell including a side wall and a bottom, wherein at least a portion of said shell is formed of a deformable material;

a frame coupled to said shell, said frame including a plurality of first portions which are spaced from one another and which extend substantially over a height of said frame and have free ends positioned near a bottom of said container; and a neck coupled to said frame, said neck delimiting an opening of said container through which said product is dispensed when pressure is applied to said shell and the shell is deformed by said pressure;

wherein said frame increases rigidity of said container but at least a portion of said container is deformable by way of said deformable material of said shell, and wherein said opening and an upper portion of said frame are circular and a diameter of said opening is smaller than a diameter of said upper portion.

65. A container as recited in claim 64, wherein said frame is formed of a material having a rigidity greater than that of said deformable material of said shell.

66. A container as recited in claim 65, wherein said frame is disposed inside of said shell.

67. A container as recited in claim 64, wherein a material of said frame is not present in respective spaces between said plurality of first portions to thereby assist in retaining deformability of said container by way of said deformable material of said shell.

68. A container according to claim 64, further comprising: a lid configured to close said opening and configured to interact with said neck.

69. A container according to claim 68, wherein an outer surface of said neck has a screw thread which interacts with a corresponding screw thread of said lid.

70. A container according to claim 68, wherein said shell and said frame are configured to fit between a thumb and an index finger of a user's hand.

* * * * *